US005730823A

United States Patent [19]

Donat

[11] Patent Number: 5,730,823

[45] Date of Patent: Mar. 24, 1998

[54] FILM AND METHOD FOR THE TRANSFER OF CUT GRAPHICS MADE OF ADHESIVE FILM

[76] Inventor: Axel Donat, Gewerbegebiet I, 07907 Oettersdorf, Germany

[21] Appl. No.: 527,272

[22] Filed: Sep. 12, 1995

Related U.S. Application Data

[63] Continuation-in-part of PCT/EP94/00745 Mar. 12, 1993.

[30] Foreign Application Priority Data

Mar. 12, 1993 [DE] Germany ..... 43 07 889.3

[51] Int. Cl.[6] ..... B44C 1/165

[52] U.S. Cl. ..... 156/230; 156/235; 156/240; 156/247; 156/291

[58] Field of Search ..... 428/542.2, 156, 428/343; 156/60, 230, 235, 240, 247, 250, 248, 277, 268, 291, 344

[56] References Cited

U.S. PATENT DOCUMENTS 2,830,001 4/1958 Barnes et al. ..... 428/167

5,344,693 9/1994 Sanders ..... 428/167

5,589,246 12/1996 Calhoun et al. ..... 428/167

*Primary Examiner*—Donald Loney

*Attorney, Agent, or Firm*—Horst M. Kasper

[57] ABSTRACT

The invention relates to a transfer film and a method for the transfer of cut graphics made of adhesive film. According to the invention, the transfer film has on both sides a differentiated surface structure made of spherical shell-like and web-like profile segments distributed over the entire surface, the profile segments of one film side having a thin adhesive layer. As a result of a program-controlled partial activation of the adhesive force of the coated profile segments of the transfer film by means of a mechanical pressure force of a plotter, direct access to the positive of the cut graphic of the adhesive film is achieved with the simultaneous omission without substitution of the conventional degridding, as is the direct, bubble-free transfer of the cut graphic by means of the transfer film to an external target surface. Apart from dispensing with an additional degridding film, the new transfer film and its application according to the method result in further advantages when transferring the graphic, in particular the possibility for the first time of applying the graphic dry without the addition of liquid.

4 Claims, 3 Drawing Sheets

FILM AND METHOD FOR THE TRANSFER OF CUT GRAPHICS MADE OF ADHESIVE FILM

CROSS-REFERENCE TO RELATED APPLICATIONS

This application is a continuation-in-part application of another international application filed under the Patent Cooperation Treaty on Mar. 10, 1994, bearing Application No. PCT/EP94/00745, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The present invention relates to a film for the transfer of cut graphics made of adhesive film and a method for the transfer of cut graphics made of adhesive film by means of such a transfer film.

The field of application of the invention comprises the commercial identification and labeling of goods, technical devices and industrial products and installations, and the field of advertising through visible and external surfaces by means of letters, words, signs, symbols, figures and images made of program-controlled cut graphics, preferably made of self-adhesive film.

2. Brief Description of the Background of the Invention Including Prior Art

Previously known films for the transfer of cut graphics made of adhesive film have, without exception, smooth, homogeneously designed adhering or adhesive bonding sides and surfaces and often consist of paper. As a result of this smooth and homogeneous surface structure, they are also suitable for exerting an adhering and bonding force which is uniform over the entire surface, as is common in the case of conventional transfer films. However, previously known films are therefore completely unsuitable for exerting partially differentiated adhering or bonding forces with respect to partially specified surface parts of an adhesive film.

These known transfer films are thus not suitable as tools for the transfer of adhesive films by machine.

The previously widespread method for the transfer of adhesive film therefore requires a previous, so-called degridding of the adhesive film from the graphic negative, which is predominantly carried out manually, in that the negative mask assigned to a positive graphic of a cut adhesive film, or the filling pattern of the letters, signs, etc. is pulled off by hand selectively and is disposed of after this process as unusably deformed. This manual degridding of the cut positive graphic is extremely laborious and unproductive, particularly in case of a sign height within a range around 10 cm.

A mechanical holding device has also been disclosed which somewhat facilitates the manual degridding, in that the parts of the negative mask forming a coherent area are seized as a whole and pulled off from the adhesive film by means of advancing a machine. However,.the manual selection of insular parts of the graphic negative is not eliminated thereby. (Publication "Werbetechnik", WNP Verlag GmbH, Munich 1993, edition 3.93, "Fastweeder automatic degridder", p. 26–28).

The further mechanization of the manual removal of the negative mask from the cut adhesive film, the so-called "degridding", by means of its own separate "degridding film", provided for this purpose, and by means of program-controlled partial bonding to the negative mask, has been taught in accordance with EP 0 470 645 A1. The additional degridding film proposed in this case, having embedded microcapsules containing an adhesive bonding agent, has, however, proven to be completely unsuitable since it does not precisely seize the graphic negative and likewise partially fills the graphic positive with adhesive bonding agent. Furthermore, these degridding films and the corresponding degridding method are completely impracticable since they do not eliminate the previously common degridding but prolong it in a time-consuming manner and make it considerably more expensive by using an additional degridding film.

To automate the transfer of cut graphics made of adhesive film, it therefore requires a completely novel transfer film and a completely novel method which applies this new transfer film and makes degridding completely superfluous.

SUMMARY OF THE INVENTION

1. Purposes of the Invention

The object of the invention is therefore the provision of a transfer film having a differentiated surface structure for seizing by a machine and for the transfer of cut positive graphics made of adhesive film.

The object of the invention is, furthermore, the application of such a transfer film on the process side for seizing said transfer film with a machine and for a transfer of cut positive graphics made of adhesive film to a target surface while omitting a conventionally required additional step of degridding an adhesive film without providing any substitution for such degridding step.

These and other objects and advantages of the present invention will become evident from the description which follows.

2. Brief Description of the Invention

According to the present invention, there is provided for a method for the transfer of cut planar shapes made of adhesive film. The method comprises the following steps. A transfer film with a spatially profiled surface structure and having on one side elevations furnished with a coating with an adhering agent and having depressions furnished with a coating with an adhesive agent is placed onto an adhesive film including a planar shape and a complimentary planar shape, surrounding the planar shape, both derived from a cut adhesive film. The transfer film and the planar shape of the cut adhesive film, with the complementary planar shape surrounding the planar shape, are connected in a fixed position as a result of adhering by means of the surface parts of the transfer film coated with the adhering agent engaging the adhesive film. The adhesive film and the transfer film are partly bonded in the region of the planar shape by bringing those surface parts of the transfer film, which are positioned in the region of the planar shape and which are coated with an adhesive agent, into contact with the planar shape, by means of a contact force. The planar shape of the adhesive film is pulled off from a silicone layer by engaging the transfer film bonded to the planar shape of adhesive film, while the complementary planar shape of the adhesive film remains completely in its position on the silicone layer disposed beneath the complimentary planar shape. The planar shape of the adhesive film is applied to any desired target surface by means of the transfer film partly bonded to the planar shape of the adhesive film.

The adhesive film and the transfer film can be partly bonded in the region of the planar shape of the adhesive film as a result of a contact force on the transfer film by means of a program-controlled plotter pen which is aware of the cutting path between the planar shape and the complimentary planar shape. Said plotter pen can follow said cutting path at a predetermined distance.

The present invention further provides for a film for a transfer of planar shapes made of adhesive film. A transfer film has a first side exhibiting a spatially profiled surface structure made up of elevations and depressions. The elevations are coated with an adhering agent for being placed in immediate contact with an adhesive film disposed beneath the transfer film. The depressions are coated with an adhesive agent and are not being placed in direct contact with the adhesive film disposed beneath transfer film, but are capable of being bonded to the adhesive film upon exertion of a contact pressure.

The elevations coated with the adhering agent can be of web-like design and the depressions coated with the adhesive agent can be of spherical shell design.

The surface structure of the elevations and depressions can occupy the transfer film like a mosaic over the whole area of the transfer film. Preferably, the surface structure of the elevations and depressions does not leave open gaps.

An area of the depressions, coated with the adhesive agent, of the profiled surface of the transfer film can amount to a multiple of the area of the elevations, coated with the adhering agent, of the profiled surface of the transfer film.

The planar shapes can be provided by a member of the group consisting of letters, words, signs, symbols, figures, images and combinations thereof.

The achievement of the object according to the invention consists in the provision of a transfer film having a spatially profiled surface structure made up of elevations and depressions, wherein the elevations of the transfer film are furnished with an adhering agent at a lower side and are intended to be placed directly on an adhesive film laid beneath the transfer film, and wherein the depressions of the transfer film are on a lower side coated with an adhesive agent capable of furnishing a bonding function and are not intended to be placed immediately on the adhesive film laid beneath the transfer film. Furthermore, according to a refinement of the present invention, the elevations coated with an adhering agent are of a web-like structure and the depressions coated with an adhesive agent are of spherical shell design.

According to further refinements of the transfer film of the present invention, the achievement of the object is based on a surface Structure including the elevations and depressions occupying the transfer film like a mosaic, extending over the whole area and without gaps over the transfer film, and in that the depressions, coated with an adhesive agent, of the profiled surface of the transfer film amount in their area to a multiple of the area of the elevations, coated with an adhering agent, of the profiled surface of the transfer film.

The achievement of the method for the transfer of cut graphics made of adhesive film, according to the objects recited, comprises the method steps of:

1. A transfer film, which has a spatially profiled surface structure and is coated on one side in part with an adhering agent and in part with an adhesive agent, is laid directly on a positive graphic and a negative mask of the cut adhesive film surrounding the positive mask, wherein the positive graphic and the negative mask are disposed on a silicone layer.
2. The transfer film and the positive graphic of the cut adhesive film, with the negative mask surrounding the positive graphic, are connected in a fixed position as a result of only partial adhering by means of the surface parts of the transfer film coated with an adhering agent.
3. The adhesive film and the transfer film are partially bonded exactly in the region of the positive graphic by bringing those surface parts of the transfer film which are positioned in the region of the positive graphic and are coated with an adhesive agent into contact with the positive graphic, by means of a contact force.
4. Next, the positive graphic of the adhesive film is pulled off, by means of the transfer film partly bonded to the positive graphic, from the silicone layer, while the negative mask of the adhesive film remains completely in shape on the silicone layer laid beneath the negative mask.
5. The positive graphic of the adhesive film is applied, by means of the transfer film partly bonded to it, to any desired target surface.

In a refinement of the method according to the invention, it is further disclosed that the adhesive film and the transfer film are partially bonded in the region of the positive graphic of the adhesive film as a result of a contact force on the transfer film furnished by means of a program-controlled plotter pen, where the control program of the plotter pen which is aware of the cutting path laid out between positive graphic and negative mask, and wherein the plotter pen follows said path at a predetermined distance.

As a result of the application of a transfer film according to the invention in the method according to the invention, it is nevertheless possible to use the cutting path of an adhesive film with graphic, said cutting path being produced under program control and being in any case necessary for the construction of the graphic, a second time for seizing and for transferring the adhesive graphic and specifically in such a manner that the cutting program, while using the given adhering of adhesive film and transfer film and while controlling a suitable plotter pen is repeated in a quasi-negative manner by "plotting" or contact-pressing the "inner areas of the cut path according to a filling pattern".

In this case it is clear how the differentiated surface structure of the transfer film and the program-controlled "plotting" of the adhesive areas of the positive graphics of the transfer film function together in an inseparable manner and make possible the effect according to the invention of a transfer by machine of the adhesive graphic, without previous degridding, in a particularly productive manner.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawing, in which are shown several of the various possible embodiments of the present invention.

DESCRIPTION OF INVENTION AND PREFERRED EMBODIMENT

Figure 1:
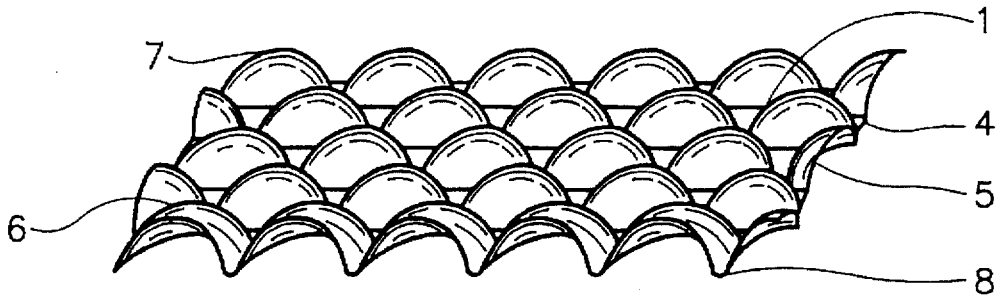
FIG. 1: shows a schematic representation of the film for the transfer of cut graphics made of adhesive film.

According to the present invention there is provided for a film structure for a transfer of cut graphics made of adhesive film. A transfer film 1 has a spatially profiled surface structure made up of elevations 4 and depressions 5. The elevations are coated with an adhering agent and intended to be placed immediately and adheringly on an adhesive film 2 laid beneath the transfer film 1. The depressions are coated with an adhesive agent and not intended to contact immediately the adhesive film 2 laid beneath the transfer film 1.

The elevations 4 coated with the adhering agent can be of web-like form and the depressions 5 coated with the adhesive agent can be of spherical shell form.

The spatially profiled surface structure of the elevations and depressions can cover the transfer film 1 like a mosaic over the whole area of the transfer film 1 and without leaving gaps.

An area of the depressions, coated with the adhesive agent, of the profiled surface structure of the transfer film 1 can amount to a multiple of an area of the elevations, coated with an adhering agent, of the profiled surface structure of the transfer film 1.

Cut graphics can be provided by a member of the group consisting of letters, words, signs, symbols, figures, images, and combinations thereof.

The present invention also provides for a method for the transfer of cut graphics made of adhesive film by means of a transfer film. A transfer film 1, having a spatially profiled surface structure and coated on one side in part with an adhering agent and in part with an adhesive agent, is placing immediately on a positive graphic 11 and a negative mask 12 of a cut adhesive film 2. Said negative mask 12 surrounds the positive graphic 11. The transfer film 1 and the positive graphic 11 of the cut adhesive film 2, with the negative mask 12 surrounding the positive graphic 11, are connected in a fixed position based on only partial adhering by means of the surface parts of the transfer film 1 coated with the adhering agent. The adhesive film 2 and the transfer film 1 are partly bonded exactly in the region of the positive graphic 11 by bringing those surface parts of the transfer film 1 which are positioned in the region of the positive graphic 11 and are coated with an adhesive agent into contact with the positive graphic 11, by means of a contact force. The positive graphic 11 of the adhesive film 2 is pulled off, by means of the transfer film 1 partly bonded to the positive graphic of the adhesive film 2, from a silicone layer 3, while the negative mask 12 of the adhesive film 2 remains completely intact on the silicone layer 3 laid beneath the negative mask 12. The positive graphic 11 of the adhesive film 2 is applied to any desired target surface by means of the transfer film 1 partly bonded to the positive graphic 11 of the adhesive film 2.

The adhesive film 2 and the transfer film 1 can be partly bonded in the region of the positive graphic 11 of the adhesive film 2 as a result of a contact force on the transfer film 1 by means of a program-controlled plotter pen 9 which program-controlled plotter pen 9 recognizes the cutting path between positive graphic 11 and negative mask 12 and follows said path at a distance.

The transfer film 1 for seizing and transferring the positive graphic made of adhesive film 2 is designed to be capable of in part adhering and in part bonding on one side and has a profiled surface structure made of open elevations 4 and open depressions 5.

The elevations can be disposed in a rectangular or parallelogram-like layout. The distance of neighboring elevations depends on the material employed for the transfer film and on the force applied to achieve bonding. The distance of neighboring elevations can be from about 0.4 millimeters to about 3 millimeters, is preferably from about 0.8 to 2 millimeters, and more preferably from about 1 to 1.5 millimeters.

As a result of the paper-thin construction of the transfer film 1, the profiled structure of the transfer film 1 shows on a first surface of a first side an elevation 4, where a depression 5 is disposed on a second surface of a second side, and vice versa shows on the first surface of the first side a depression 5, where an elevation 4 is disposed on the second surface of the second side. This means with other words that the profiled elevations 4 of one side of the transfer film 1 are the reverse of matching depressions 5 of the corresponding other side, and the profiled depressions 5 of one side are the reverse of matching elevations 4 of the corresponding other side. The elevations on the first side 4 are coated with an adhering agent and the depressions 5 on the first side are coated with an adhesive agent. An adhering agent exhibits sticky properties in that two surfaces adhering based on the adhering agent are connectable and again detachable with little force. An adhesive agent in contrast bonds, where the bonding surfaces are connectable and again detachable only in a presence of a high force, i.e. a higher force than in case of adhering surfaces. The force required for separation of the bonding is from about 5 to 1000 times stronger than the force required for separation of the adhering and is preferably from about 10 to 100 times stronger than the force required for separation of the adhering surfaces. It is basically of no importance which one of the sides of the transfer film 2 is coated with the adhering agent and adhesive agent. It is however important that the transfer film 2 be coated on one side in part with the adhering agent and in part with the adhesive agent and that the surface sections, which are coated with the adhesive agent, are disposed spatially recessed as compared to the surface sections, which are coated with the adhering agent, such that the adhesive agent is initially placed passively until the program-controlled plotter pen partially presses on the surface section, coated with the adhesive agent, and bonds same in the region of the positive graphic. The adhesive film is for example an advertising element conventionally used in the advertising field, where the adhesive film exhibits a bonding layer for the purpose of self-adhesion on an advertising surface. Such an adhesive film is also called a self-adhesive foil in the advertising field. The dimensions of an adhesive film are known from the field of advertising graphics and have been used worldwide.

The transfer film 1 in this arrangement is coated on only one side with an adhering agent and a adhesive agent, where the elevations 4, coated on one side with adhering agent, are intended to be pieced directly on the adhesive film 2 laid beneath the transfer film 1, while the depressions 5, coated on one side with an adhesive agent, are not intended to be placed immediately on the adhesive film 2 laid beneath the transfer film 1. The spatially profiled elevations 4 and depressions 5 are distributed uniformly over the entire surface of the transfer film 1, where those portions of the surface of the transfer film 1 coated with a adhesive agent distinctly outweigh those portions of the surface of the transfer film 1 coated with an adhering agent. The elevations 4 and the depressions 5 are executed by means of radii 7, 8 having contours without edges, in order to enable a plotter pen 9, which scans that outer side of the transfer film 1, which side is facing away from the adhesive film 2, to make a smooth advance. The profile height 6 of the elevations 4 and depressions 5 is uniform because of a uniform plotter stroke but is expediently designed matched to the type of transfer film 1. The profile height can be from about 0.1 to 0.5 times the distance between neighboring elevations and is preferably from about 0.2 to 0.4 of the distance between neighboring elevations. The purpose of the transfer film 1 according to the present invention is not directed to its dimensions but to its spatial structure of its surface as well as to its differentiated coating of said surface with adhering agents and adhesive agents.

The radii 7, 8 of the elevations 4 and of the depressions 5 are radii having the dimensions of paper-thin foils of the advertising graphics. It is important in this regard that the stroke of the plotter pen is not impeded by sharp edges and its accuracy and precision is not influenced.

Plotter-head controls with an accuracy of about 0.1 mm belong to the standard equipment of high-quality flat-bed plotters, such as for example the plotters manufactured by the company Zünd of Switzerland and such plotters are widely used in the United States. This degree of tolerance is three-dimensional, i.e. the accuracy is also present in regard to the cut depth. This precision with a tolerance of about 0.1 mm guarantees the integrity and soundness of the silicone layer 3.

In connection with the producing of a positive graphic, the adhesive film 2 disposed on the silicone layer 3 is cut and the cut is recorded electronically. Then a transfer film 1 is placed on top of the adhesive film 2. Based on the electronically recorded cut, a plotter then fills the areas on transfer film 1 corresponding to the positive graphic by pressing against the transfer film 1 in Corresponding areas.

According to the present invention, the transfer film 1 is placed on the adhesive film for the purpose of the partial plotting and the transfer of the positive graphic only after the cut of the adhesive film, where the cut in the adhesive film separates the positive graphic from the negative mask. During the plotting, the active plotter head does not carry a knife but a plotter pen.

The connection involving bonding occurs by a loose overlaying and adhering of the transfer foil on the cut adhesive film for the purpose of the partial plotting of the positive graphic and leaving a graphic negative without plotter impressions.

By means of applying a program-controlled mechanical contact force of a contact pen 9 on the back side of the depressions 5 coated with an adhesive agent of the transfer film 1, wherein the locations are determined by the cutting path of the contour of the positive graphic 11, the spatially profiled depressions 5 coated with a layer of adhesive agent of the transfer film 1 are deformed, are brought into contact with the adhesive film 2, and the depressions of the transfer film 1 are partially bonded to the cut positive graphic 11 of the adhesive film 2 only in the region of the positive graphic 11.

Since the positive graphic 11 has long been completely separated from the negative graphic as a result of the cutting step already previously carried out, it is possible, as a result of the partial bonding of the transfer film 1 to the positive graphic 11 of the adhesive film 2, to execute a direct access to the positive graphic 11, wherein the step of the "degridding" is additionally omitted without being substituted by another step, and wherein one dispenses with an additional step of "degridding film" without employing a substitution, such as to execute the transfer of the positive graphic 11 with the transfer film 1 to any desired external target surface.

This method according to the invention is possible only as a result of the structure according to the invention of the transfer film 1, as a result of which the transfer film 1 both partially seizes the positive graphic 11 and also simultaneously transfers it cleanly to a target surface. This transfer film can thus be designated a "two-step film", which results in a new capability being characterized which has none of the previously known conventional "degridding films" and "transfer tapes".

The adhering agent of the elevations 4 of the transfer film 1 and the adhesive agent of the depressions 5 of the transfer film 1 are dispersible which makes both an easy and cleanly detachable fixing and adhering of the transfer film 1 on the adhesive film 2 possible and also the partially and temporarily bonding connection of the transfer film 1 to the adhesive film 2 in the region of the positive graphic 11.

In this arrangement, the technological stage of the production of the transfer film 1 at which the adhering agent and/or adhesive agent are applied has no influence on the nature of the transfer film 1 according to the invention.

An essential feature of the transfer film 1 is that the elevations 4 and depressions 5 are finely distributed over the entire surface and disposed in a cooperating manner in order to be able to achieve both a minimal, easily detachable adhering to the adhesive film 2 and, in particular, a fine, partially exact and practically gap-free bonding to the positive graphic 11 of the adhesive film 2. For this purpose, the surface parts of the elevations 4 and of the depressions 5 are preferably selected such that the surface parts of the depressions 5 exceed those of the elevations 4.

In the process for transferring the adhesive film 2 by means of a transfer film 1, the adhering assembly of adhesive film 2 and transfer film 1, fixed in terms of position in a laminating machine 14 of a cutting computer 13, is fed again to the cutting region 15. A program-controlled control head 10 guides a plotter pen 9 in such a way that the depressions 5 of the transfer film 1 are partially bonded to the positive graphic 11. Program-controlled cut plotters and their specific software have been known for a decade and are commercially available world-wide. The cutter head 10 recognizes the cutting line and cuts the adhesive film based on a program control. Even a simple, commercially available cutting program for the adhesive graphics is furnished so user-friendly that it can be variably connected to or supplemented with other data. The repetition of the cutting path, or the repetition of the cutting path at a predetermined distance to the cutting path with a plotter pen is known in the art of software, as for example taught in the U.S. Pat. No. 5,277,736.

The bonding takes place by the spatially set-back depressions 5 of the transfer film 1 being pressed together by a plotter pen 9 and their adhesive being activated in an accurate shape in the region of the positive graphic 11, while the surrounding surface parts of the negative mask 12 remain unbonded in an accurate shape. During the subsequent pulling off of the transfer film 1, the firmly bonded positive graphic 11 of the adhesive film 2 is lifted exactly from the silicone layer 3 laid beneath it. The unbonded negative mask 12 remains on the silicone layer 3. Hence, the positive graphic 11 is available for the final transfer from the transfer film 1 to a target surface and also the completely untouched negative mask 12 is available for any desired use. The previous degridding as a result of detaching the negative mask 12 from a positive graphic 11 is thus eliminated exceptionally effectively and in a qualitatively perfect manner.

The danger of damaging the transfer film 1 with the plotter pen is not only given by the dimensional relationship and geometric parameters. Essential factors of the process are also the magnitude and the duration of the press-on force, the advance speed and the positional deviation of the plotter pen, the hardness of the film or foil, the hardness of the sublayer of the film or foil, the height of the characters and their smallest island dimension, the slope of the flank of the elevations and depressions, etc. All these parameters and their interactions and relationships are known from conventional procedures involving adhesive films 2.

The fact that the negative mask 12 of the adhesive film 2 remains intact at the below disposed silicone layer 3 is based according to the present invention on the partial plotting and the transfer of the positive graphic 11 by means of the transfer film 1.

The negative mask 12 is not seized and not carried along by the transfer film 1 such that the negative mask remains intact and in the state as separated by the cut from the positive graphic and is therefore independently reusable.

Therefore, the so-called degridding becomes also obsolete as well as use of an additional film or foil for the degridding, such as a foil with microencapsulated adhesive particles as disclosed in EP 0,470,645.

The silicone layer 3 is a covering of the adhesive surface of the adhesive foil 2. As a rule, such a silicon layer 3 together with the adhesive foil or adhesive film is commercially available as one piece.

Figure 2:
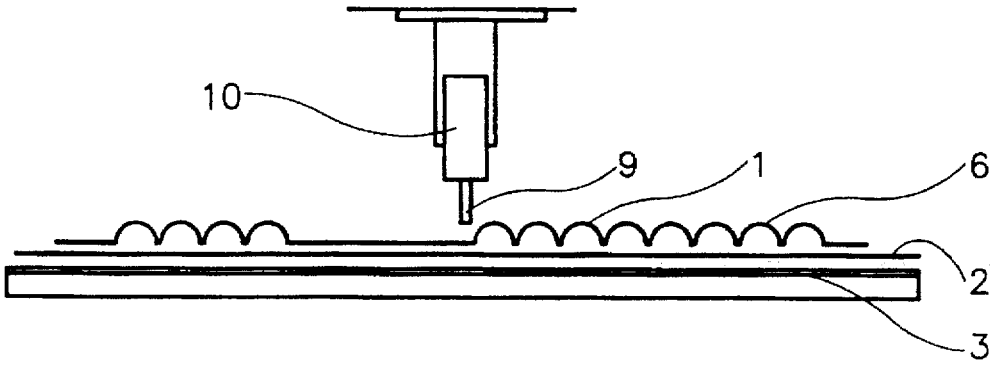
FIG. 2: shows a schematic representation of the position of the transfer film on an adhesive film under a plotter.
Figure 3:
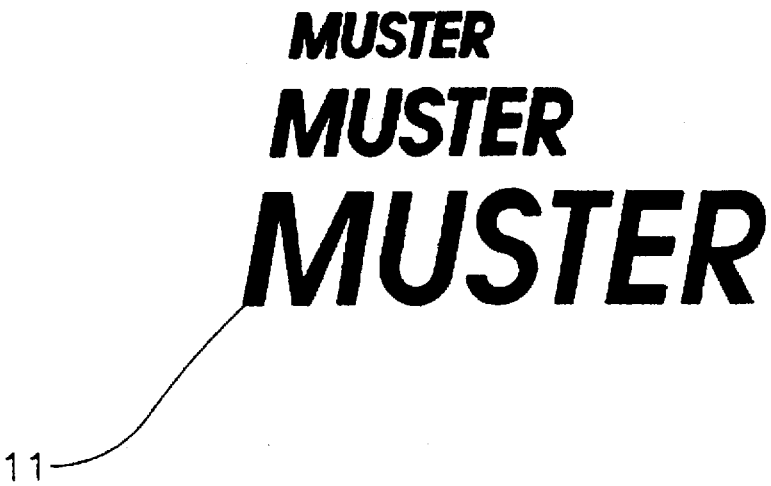
FIG. 3: shows a pattern of the positive graphic and the negative mask, completely in shape, after the transfer using the transfer film.
Figure 3:
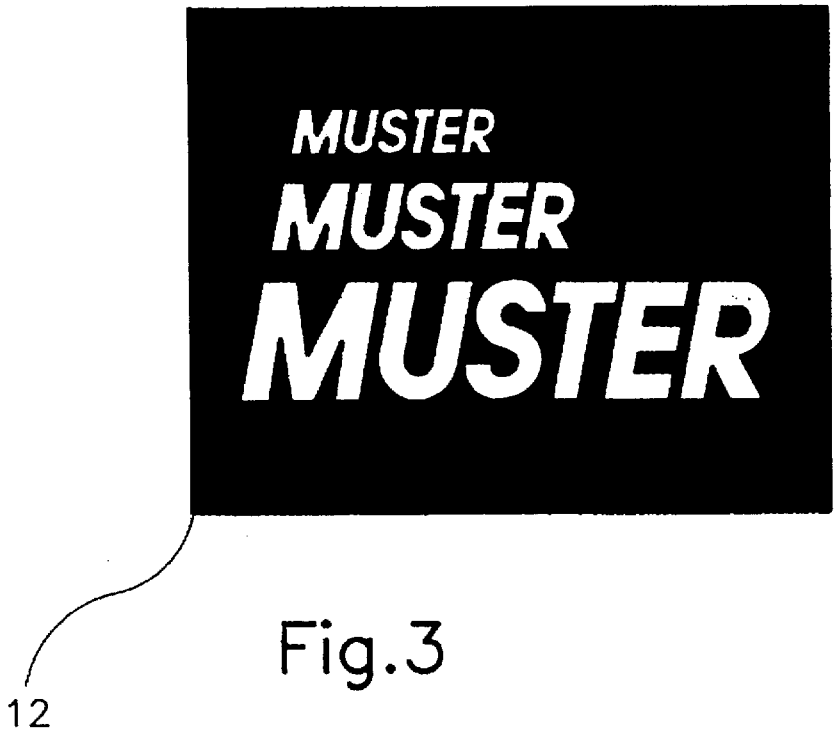
Figure 4:
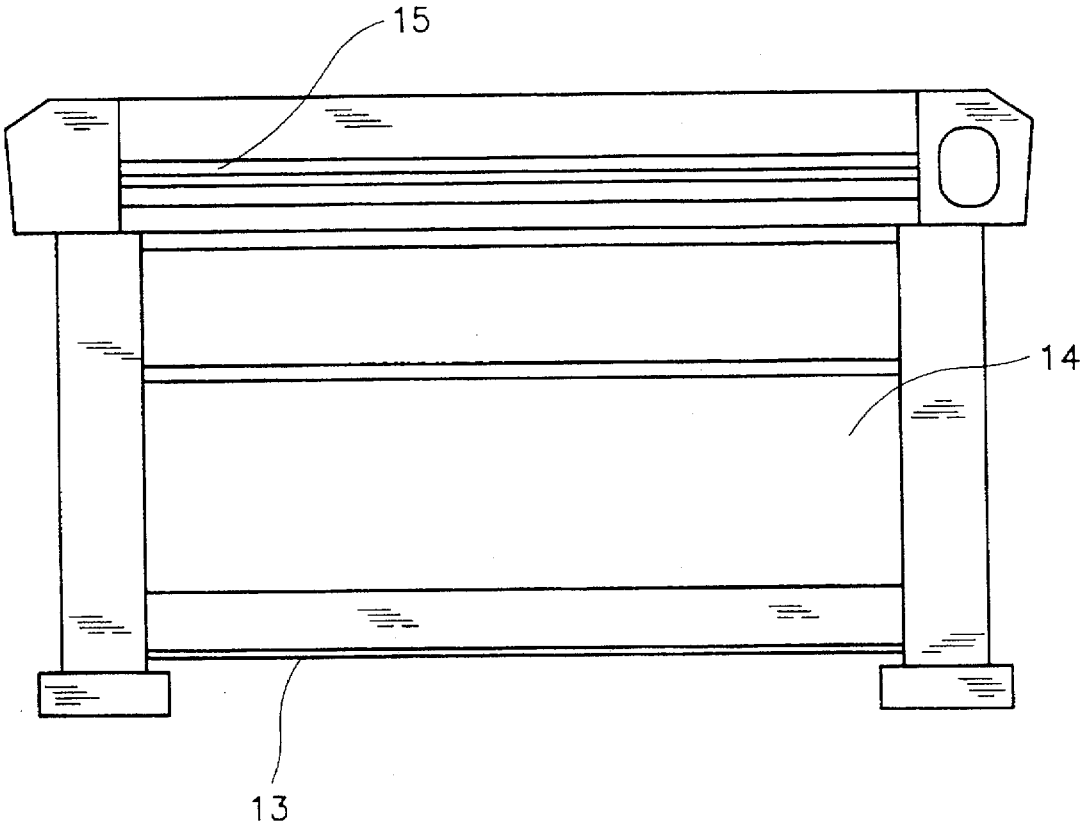
FIG. 4: shows an arrangement of cutting computer, laminating device and cutting region.

The distance shown in FIG. 2 between the transfer film 1 and the adhesive film 2 as well as the distance between the adhesive film 2 and the silicon layer 3 symbolizes that the adhesive bonding film 2 and the transfer film 1 cannot consist of a multi-layer connection or of a fixed film connection comprising several foils but that the adhesive film 2 and the transfer film 1 have to be separate individual films which are layed one over the other during the application of the invention process. It is also shown in FIG. 2 that the transfer film 1 is to be placed onto the uncoated outer surface of the adhesive film 2, that is on the viewing side of the advertising surface.

Not only is the described "reversal of the degridding", that is to say the detaching by machine of the positive graphic 11 from a negative mask 12, in this case, important for the invention. A "degridding" step becomes fully superfluous as a result of the present invention method. The possibility of repeated application of the given technical means which are present in any case for the production of the positive graphic is also useful, that is to say, the renewed use of the cutting path of the positive graphic 11 with correspondingly supplemented software for plotting the positive graphic 11.

A particularly effective configuration of the method according to the invention is thus realized.

For the purposes of completeness it should be pointed out that the method according to the invention is not bound to the use of a cutting computer having a plotting pen as represented. Other tools which exert a suitable contact force are also included in the achievement of the object according to the invention, providing they are aware of the cutting path of a positive graphic 11 and the negative mask corresponding thereto and follow said cutting path sufficiently exactly at a specific distance.

It will be understood that each of the elements described above, or two or more together, may also find a useful application in other types of cutting computers having a plotting pen differing from the types described above.

While the invention has been illustrated and described as embodied in the context of a film and method for the transfer of cut graphics made of adhesive film, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for transferring cut graphics made of adhesive film by means of a transfer film, comprising the following steps:

disposing a cut adhesive film (2) on a silicone layer (3);

placing a transfer film (1), having a spatially profiled surface structure and coated on one side in part with an adhering agent and in part with an adhesive agent, immediately on a positive graphic (11) and a negative mask (12) of the cut adhesive film (2), said negative mask (12) surrounding the positive graphic (11), connecting the transfer film (1) and the positive graphic (11) of the cut adhesive film (2), with the negative mask (12) surrounding the positive graphic (11), in a fixed position based on only partial adhering by means of the surface parts of the transfer film (1) coated with the adhering agent, partly bonding the cut adhesive film (2) and the transfer film (1) exactly in a region of the positive graphic (11) by bringing bonded surface parts of the transfer film (1) which are positioned in the region of the positive graphic (11) and are coated with the adhesive agent, into contact with the positive graphic (11), by means of a contact force, pulling the positive graphic (11) of the cut adhesive film (2) off by means of the transfer film (1), partly bonded to the positive graphic of the cut adhesive film (2), from the silicone layer (3), while the negative mask (12) of the cut adhesive film (2) remains completely intact on the silicone layer (3) laid beneath the negative mask (12), applying the positive graphic (11) of the cut adhesive film (2) to any desired target surface by means of the transfer film (1) partly bonded to the positive graphic (11) of the cut adhesive film (2).

2. The method for transferring cut graphics made of adhesive film as claimed in claim 1, further comprising partly bonding the cut adhesive film (2) and the transfer film (1) in the region of the positive graphic (11) of the cut adhesive film (2) as a result of a contact force on the transfer film (1) by means of a program-controlled plotter pen (9), which program-controlled plotter pen (9) recognizes a cutting path between the positive graphic (11) and the negative mask (12) and follows said path at a distance.

3. A method for transferring cut planar shapes made of adhesive film, comprising the following steps:

placing a cut adhesive film on a silicone layer;

placing a transfer film with a spatially profiled surface structure and having on one side elevations furnished with a coating with an adhering agent and having depressions furnished with a coating with an adhesive agent onto a cut adhesive film including a planar shape and a complimentary planar shape, surrounding the planar shape, wherein a cutting path of the cut adhesive film is provided along a line delimiting the planar shape and the complimentary planar shape;

connecting the transfer film with the cut adhesive film including the planar shape, and the complementary planar shape surrounding the planar shape, in a fixed position as a result of adhering by means of surface parts of the transfer film coated with the adhering agent engaging the cut adhesive film;

partly bonding the cut adhesive film and the transfer film in a region of the planar shape by bringing those surface parts of the transfer film which are positioned in the region of the planar shape and which are coated with the adhesive agent into contact with the planar shape, by means of a contact force;

pulling the planar shape of the cut adhesive film off from the silicone layer by engaging the transfer film bonded to the planar shape of the cut adhesive film, while the complementary planar shape of the cut adhesive film remains completely in its position on the silicone layer disposed beneath the complimentary planar shape;

applying the planar shape of the cut adhesive film to any desired target surface by means of the transfer film partly bonded to the planar shape of the adhesive film.

4. The method for transferring cut planar shapes made of adhesive film according to claim 3, further comprising partly bonding the cut adhesive film and the transfer film in the region of the planar shape of the cut adhesive film as a result of a contact force on the transfer film by means of a program-controlled plotter pen which is aware of the cutting path between the planar shape and the complimentary planar shape, and wherein said plotter pen follows said cutting path at a predetermined distance.

* * * * *